US005337854A

United States Patent [19]

Brandt

[11] Patent Number: 5,337,854

[45] Date of Patent: Aug. 16, 1994

[54] JIB ASSEMBLY

[75] Inventor: Bernd A. Brandt, Scarborough, Canada

[73] Assignee: Ontario Hydro, Toronto, Canada

[21] Appl. No.: 854,347

[22] Filed: Mar. 19, 1992

[51] Int. Cl.[5] ..... B66F 11/04

[52] U.S. Cl. ..... 182/2

[58] Field of Search ..... 182/2; 212/264

[56] References Cited

U.S. PATENT DOCUMENTS 3,828,941 8/1974 Coutinho ..... 182/2 X
4,582,206 4/1986 Johnson ..... 182/2 X
4,838,381 6/1989 Michaud et al. .

FOREIGN PATENT DOCUMENTS 1198691 12/1985 Canada .

*Primary Examiner*—Alvin C. Chin-Shue

*Attorney, Agent, or Firm*—Ridout & Maybee

[57] ABSTRACT

A jib assembly is disclosed, for use with an articulated boom carried by an aerial device, having a compact configuration of components which allows a high degree of freedom in the rotation of the jib in the vertical plane and reduced obstruction of the rotational adjustment of the bucket carrier on the boom in the horizontal plane, relative to existing arrangements. A chain and sprocket arrangement driven by a hydraulic motor powers rotation of the jib coaxially with the bucket shaft and, where a winch is used, with the axis of rotation of the winch. The arrangement simplifies the routing of hydraulic hoses and affords a more compact and less cluttered arrangement of components at the tip of the boom, which has safety advantages in the environment of a tight distribution of power lines, where distances between live and grounded apparatus are small.

9 Claims, 4 Drawing Sheets

JIB ASSEMBLY

FIELD OF INVENTION

This invention relates to an improved jib assembly for use in the handling of materials by an aerial device. In particular, the jib assembly of the present invention is of use in association with a truck-mounted articulated or telescoping boom for handling electrical conductors and other materials in the construction and maintenance of power transmission and distribution lines.

BACKGROUND OF THE INVENTION

The use of a truck-mounted articulated boom for moving a workperson to an elevated work position is well known. A bucket carrier is so mounted to the arm of the boom as to maintain a vertical orientation irrespective of the angle of the boom. This may be accomplished by securing the bucket to a shaft coupling which is freely axially rotatable with respect to the boom and providing a boom-carried levelling system to rotate the bucket shaft in a sense that compensates for motion of the arm of the articulated boom. The bucket itself may also be pivotably movable in a horizontal plane, for adjusting the position of the person carried in the bucket relative to the boom and a work jib mounted to the boom, by means of a bucket rotation drive system between the bucket shaft and the bucket carrier.

To assist the workperson in the bucket carrier, there is usually provided a work jib near the end of the boom. The jib assembly comprises a jib which is slidable and lockable within a sleeve that is pivotably mounted to the boom, proximate the bucket carrier. Hydraulic driving means may be provided for extending and rotating the jib within a vertical plane. There may also be provided a hydraulically driven winch, if needed for the handling of materials, mounted to the boom or to the jib sleeve.

Two jib assemblies generally of the type disclosed herein are described in Canadian patent No. 1,198,691 issued Dec. 31, 1985 to Amador Hydraulics Services Limited and U.S. Pat. No. 4,838,381 issued Jun. 13, 1989 to Posi-Plus Technologies Inc.

The Amador jib assembly comprises a jib and a speed reducer which includes a worm gear concentric with the bucket shaft and freely rotatable relative thereto and a hydraulic motor-driven worm for rotating the worm gear to effect rotation of the jib in the vertical plane.

In the articulated boom jib assembly disclosed in the Posi-Plus patent, the jib member has an attachment sleeve element secured thereto, which is in turn secured to a drive gear coupling element in toothed engagement with the output drive gear of a planetary gear reducer securable inside the boom. The Posi-Plan arrangement is intended to address a disadvantage of the Amador construction, by supporting the jib closer to the boom to reduce stress on the gear coupling caused by the load associated with the jib assembly and on the bucket support shaft.

However, none of the prior art jib assemblies is entirely satisfactory for use in the tightly spaced and hazardous environment of power distribution lines, particularly when the operator requires in addition to the functions of jib rotation and jib extension a powered winch for raising and lowering materials to the elevated work station. The prior art devices all employ bulky winches which have hydraulic hose and winch cable routing problems.

In conventional arrangements including a hydraulic motor-powered winch mounted to the arm at the boom or to the jib, the associated hydraulic hoses lie outside the jib and have to "sweep around" with the jib to the extent that the jib is rotated in use. This restricts rotational freedom and particularly precludes having usable tools at both ends of the work jib. To varying degrees, the hydraulic winch and hose configurations in known jib assemblies also restrict bucket rotation in the horizontal place and can impede access to the jib controls from the "passenger" bucket, in a two bucket carrier.

The cable routing problems of the prior art referred to above stem from the rotation axis of the winch being displaced from the rotation axis of the jib, so that the cable is not in alignment with the groove of the pulley sheave in the tip of the jib. In time, this can lead to chafing and even cutting of the winch cable.

It is, accordingly, an object of the present invention to provide an improved jib assembly having a compact configuration of components which allows a high degree of freedom in the rotation of the jib in the vertical plane and minimal obstruction of the rotational adjustment of the bucket carrier in the horizontal plane, to provide the workperson carried in the bucket with a preferred positioning of the jib for conductor and other material handling.

It is a further object of the invention to provide an improved jib assembly for use with a boom carried by an aerial device, the boom arm having a bucket carrier for a workperson on a freely rotatable shaft extending through the boom, wherein rotation of the jib is effected by hydraulic chain drive means including a jib rotation output sprocket coaxial with the bucket shaft and freely rotatable in relation thereto, affording a relatively compact configuration for the jib assembly.

It is a further object of the invention to provide an improved jib assembly for use with a boom carried by an aerial device as aforesaid, further comprising a compact and light winch concentric with both the bucket support shaft and the jib rotation output sprocket.

It is a further object of the invention to provide an improved jib assembly for use with an articulated boom, wherein jib rotation is effected by compact chain-and-sprocket drive means fixed to the boom tip, and comprising a compact winch coaxial with the output sprocket of the jib rotation drive means and winch rotation drive means also fixed to the boom tip, so that the winch cable is lined up with the sheaves of a pulley at one end of the jib.

SUMMARY OF THE INVENTION

With a view to alleviating the aforementioned problems and achieving the aforementioned objects, the present invention is directed to an improved jib assembly for use with an articulated boom carried by an aerial device, said boom having a workperson carrier mounted on a freely rotatable shaft extending through the boom. The jib assembly according to the invention comprises a jib, a jib sleeve slidably and lockably carrying the jib, a chain speed reducer, a motor for driving the chain speed reducer and a connector for connecting the chain speed reducer with the jib sleeve and rotating the jib sleeve to provide a continuous range of rotation of the jib in a vertical plane as the sleeve is rotated by the motor through the chain speed reducer and connector. The chain speed reducer further comprises at least one chain and one pair of sprocket wheels, one of said sprocket wheels being a rotation output sprocket wheel coaxial with the shaft, freely rotatable in relation to the shaft and connected to said connector.

In a preferred embodiment, the jib assembly further comprises a motor-driven winch which is coaxial with both the shaft and said rotation output sprocket wheel and freely rotatable with respect to each. The central cross- section of the winch is coplanar with the vertical rotation plane of the jib.

By the use of a jib assembly constructed according to the invention, the aforementioned objects may be achieved. In particular, if a hydraulic motor is used for driving the speed reducer, it is possible by virtue of the mechanical arrangement of the invention to mount the hydraulic motor on the boom so that essentially the entire length of hoses for the circulation of hydraulic fluid for the motor is housed inside the boom.

BRIEF DESCRIPTION OF THE DRAWINGS

In drawings which illustrate embodiments of the invention.

DETAILED DESCRIPTION OF PREFERRED EMBODIMENT

Figure 1:
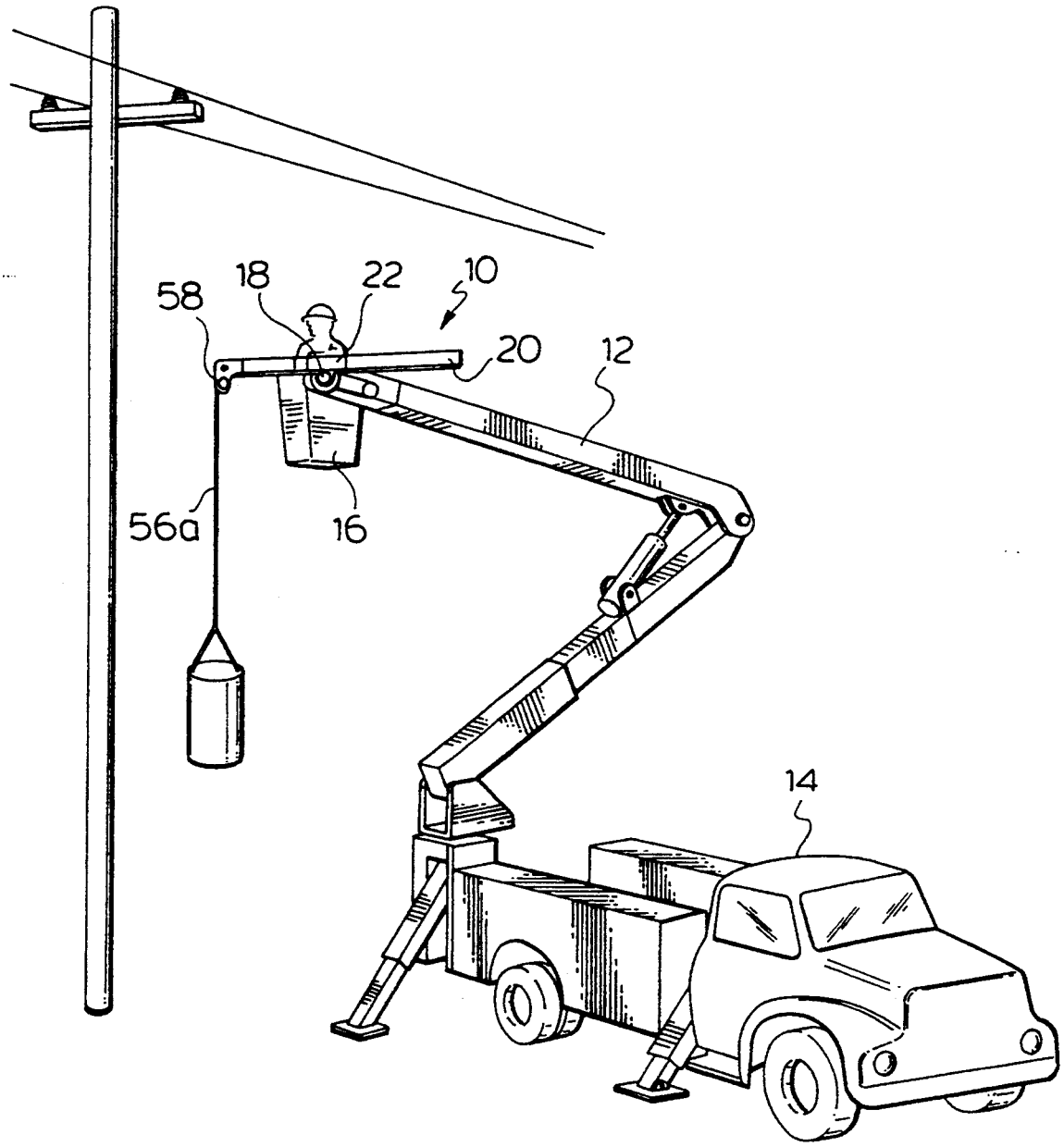
FIG. 1 shows a jib assembly in use, in combination with the articulated boom of a truck-mounted aerial device.

FIG. 1 illustrates a particular application of the jib assembly according to the invention. A jib assembly 10 is provided at the end of an articulated boom 12 which is conventionally mounted on truck 14.

Figure 2:
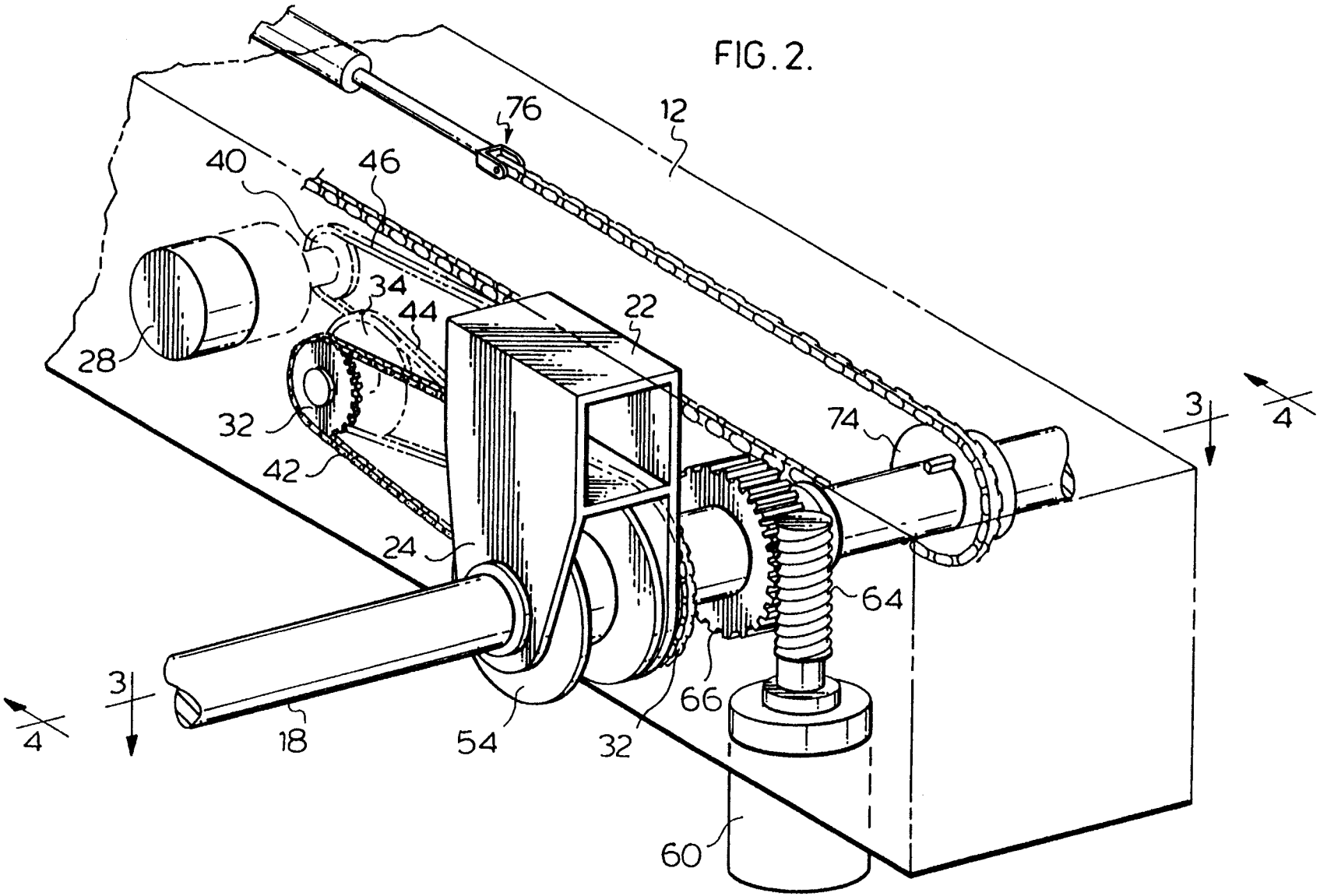
FIG. 2 is a perspective view of a jib assembly according to the invention.
Figure 3:
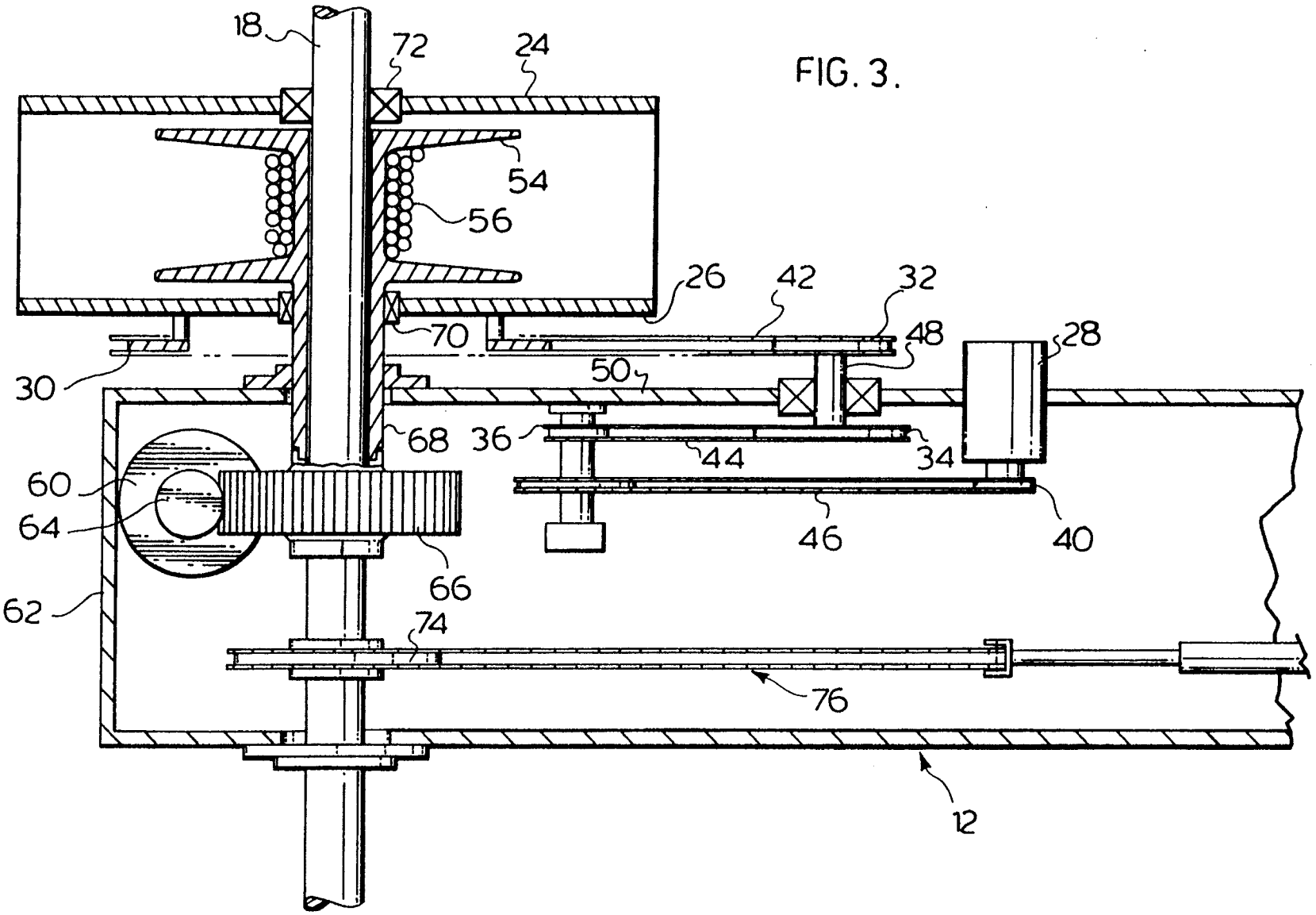
FIG. 3 is a cross-sectional view of the jib assembly of FIG. 2, seen along the arrows 3—3.

Jib assembly 10 is used to assist, in the handling of materials, a person carried in bucket carrier 16, which itself is secured to the end of boom 12 by connection to rotatable shaft 18, best seen in FIGS. 1 and 2. Bucket carrier 16 moves rotationally with shaft 18 when shaft 18 rotates relative to the end of boom 12.

Bucket carrier 16 may be pivotably mounted to one end of shaft 18 by a conventional bucket rotation drive system (not shown), so that bucket carrier 16 is freely rotatable about an axis perpendicular to shaft 18.

Figure 4:
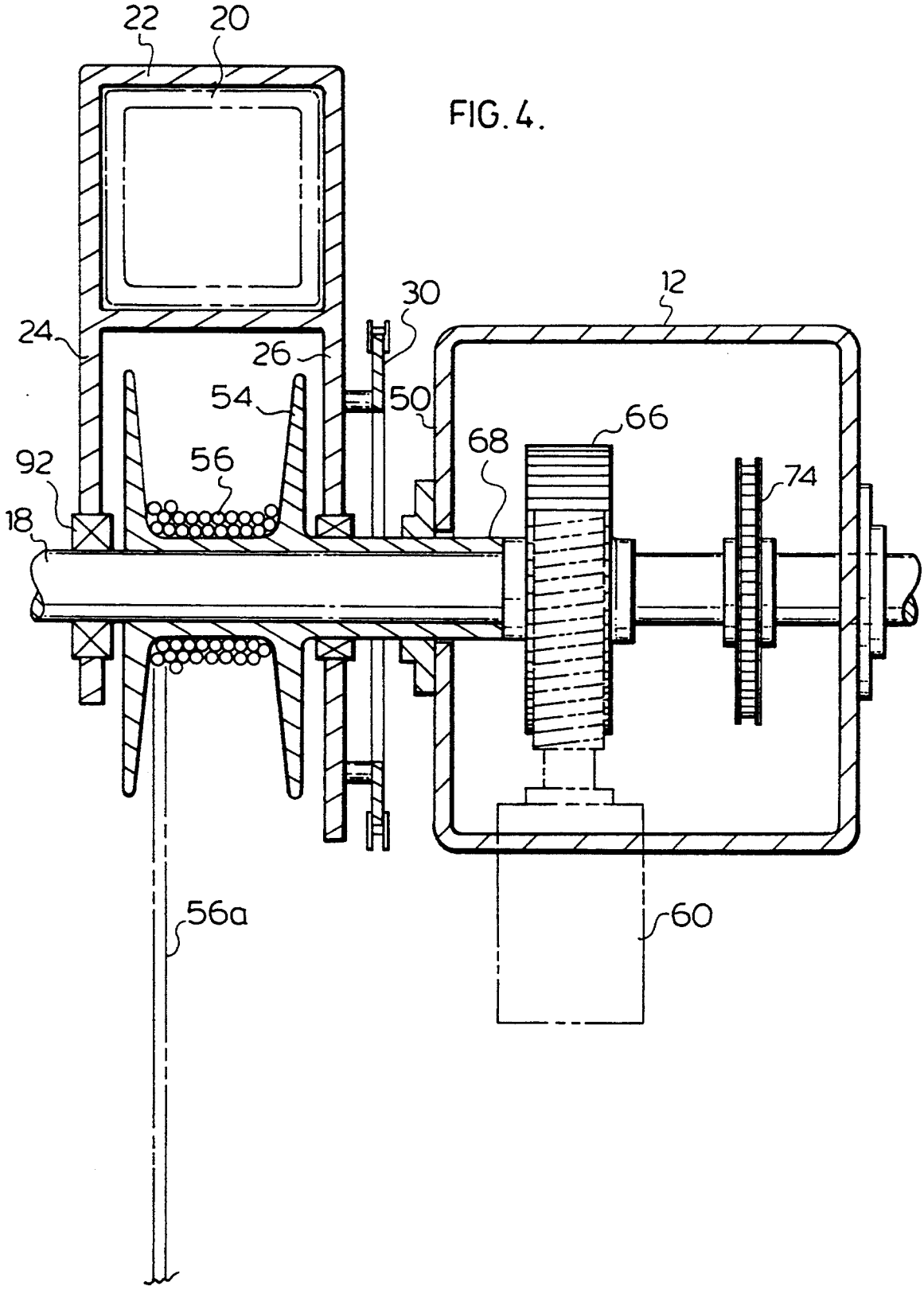
FIG. 4 ,is a cross-sectional view of the jib assembly of FIG. 2, seen along the arrows 4—4.

As best seen in FIGS. 1, 2 and 4, jib assembly 10 comprises a jib 20 slidably extending through a jib housing 22. Two quadrant plates 24 and 26 extend respectively from each side of housing 22 and are rotatably mounted on shaft 18 proximate one side of boom 12. The rotary movement of the jib with its housing is powered by jib motor 28 through a chain speed reducer. In the illustrated embodiment, a 3-stage reduction is employed, comprising 6 sprocket wheels 30, 32, 34, 36, 38 and 40, and three lengths of endless chain 42, 44 and 46, each looped about and connecting the sprocket wheel pairs 30–32, 30–36 and 38–40, respectively. Jib motor 28 is provided with conventional auto-braking means to dampen rotary movement of the jib when jib motor 28 is turned off.

Sprocket wheel 30 is secured to the outer side of quadrant plate 26 and is coaxial with shaft 18. It is the rotation output sprocket wheel. Sprocket wheels 32 and 34 are securely mounted on a first short spindle 48 at each end, respectively. Spindle 48 rotatably extends through the sidewall 50 of boom 12 and is supported by wall 50. Sprocket wheels 36 and 38 are securely mounted on a second short spindle 52, which is rotatably mounted on the side wall 50 and extends inwardly therefrom. Sprocket wheel 40 is secured on the drive shaft of motor 28, which is mounted on the inside surface of wall 50.

The two sprocket wheels at each pair 30 and 32, 34 and 36, and 38 and 40 are coplanar. The diameter ratio of the sprocket wheels in each pair is in the range of 2:1 to 3:1, but the appropriate speed revolution ratio will of course be dependent upon the choice of jib motor 28.

The longitudinal movement of jib 20 relative to jib housing 22 is effected manually according to the embodiment illustrated in the figures and can be locked at any position by any of a number of well known conventional means such as, for example, the holes and pins illustrated in aforementioned Canadian Patent No. 1,198,691. Alternatively, jib extension may be hydraulically powered. If powered, a hydraulic cylinder can be mounted on the winch housing in a conventional manner. The compactness of the winch and jib rotators in the arrangement of the present invention allows for more ready accommodation of cylinder supports and hose routing for the jib extension drive.

The jib assembly of the invention further optionally comprises a winching system, including a winch wheel 54 rotatably mounted on shaft 18 and positioned between quadrant plates 24 and 26. A length of cable 56 is wound onto winch wheel 54 and has its free end **56*a* extending from winch wheel 54 and over a fixed pulley 58 attached to one end of jib 20. The free end of cable 56 hanging down from fixed pulley 58** may be coupled to any tool, for example a hook.

Winch wheel 54 is driven by a winch motor 60 via a speed reducer. In the illustrated embodiment, this is a worm gear speed reducer, but a planetary gear arrangement could be employed. Winch motor 60 is secured to the inside surface of the end wall 62 of the boom 12 and has a rotation axis which is perpendicular to and non-intersecting with the axis of shaft 18. A worm 64 extending from the end of the drive shaft of the motor 60 along its rotation axis meshes with worm gear 66, which is rotatably mounted on shaft 18 inside boom 12.

A sleeve connector 68 is rotatably mounted on shaft 18, extending through side wall 50, quadrant plate 26 and sprocket wheel 30, opposite ends of sleeve connection 68 being connected to worm gear 66 and winch wheel 54, respectively, to transmit the drive from motor 60 to winch wheel 54. A bearing 70 is provided between quadrant plate 26 and the outer surface of sleeve connector 68 and a second bearing 72 is provided between quadrant plate 24 and shaft 18.

To maintain the bucket carrier in a vertical orientation irrespective of the positioning of articulated boom 12, the bucket carrier is adjusted by rotary movement of shaft 18 relative to boom 12, which movement is effected by a well known and conventional levelling system. For example, sprocket wheel 74 securely mounted on shaft 18 is connected by a set 76 of chains and rods to the turret of the boom assembly.

In such an arrangement, three rotational functions are effected around the axis of shaft 18. At the innermost position there is the rotation of shaft 18 to provide an adjustment to bucket carrier 16 to maintain its vertical position. At the outermost, there is the joint rotation of jib 20, housing 22, quadrant plates 24 and 26 and sprocket 30. Intermediate these is the joint rotation of the winch 54, sleeve connector 68 and worm gear 66. There is no interference between the three rotational degrees of freedom.

It will be appreciated that the present invention is not limited to the specific preferred embodiment described above. Thus, although the combination of a jib assembly with an articulated boom is illustrated and described, an improved jib assembly according to the invention, employing a chain speed reducer for rotational drive at the jib coaxially with rotation at a bucket shaft sould readily be adapted for use with a telescopic boom carried by a truck or the like.

I claim:

1. An improved jib assembly for use with an articulated boom carried by an aerial device, said boom carrying a workperson carrier on a freely rotatable shaft extending through the boom, the jib assembly comprising:

a jib, a jib sleeve mounted on said shaft for rotation about said shaft, said jib being carried slidably and lockably in said jib sleeve, a chain speed reducer, a motor for driving said chain speed reducer and a connector for connecting said chain speed reducer to said jib sleeve and for rotating said jib sleeve to provide a continuous range of rotation of said jib in a vertical plane as said sleeve is rotated by said motor through said chain speed reducer and connector;

said chain speed reducer further comprising at least one chain and one pair of sprocket wheels, one of said sprocket wheels being a rotation output sprocket wheel coaxial with said shaft, attached to a wall of said jib sleeve, freely rotatable in relation to said shaft, and connected to said connector.

2. An improved jib assembly according to claim 1, further comprising a winch which is coaxial and freely rotatable with respect to both said shaft and said rotation output sprocket wheel, the central cross-section of said winch being coplanar with said vertical rotation plane of said jib.

3. An improved jib assembly according to claim 2, wherein said motor for driving the rotation of said jib is a hydraulic motor mounted to said boom so that substantially the entire length of cable for circulating hydraulic fluid for said motor extends along the inside of said beam.

4. An improved jib assembly according to claim 2, wherein said connector comprises a plate rotatable coaxially with said rotation output sprocket wheel.

5. An improved jib assembly according to claim 2, wherein said chain speed reducer is a multiple chain speed reducer comprising, at each stage of speed reduction from said hydraulic motor to said rotation output sprocket wheel, a pair of sprocket wheels operatively connected by an associated endless loop of chain, said rotation output sprocket wheel belonging to a final pair of operatively connected sprocket wheels at the last stage of speed reduction.

6. An improved jib assembly according to claim 5, wherein all but the final pair of sprocket wheels and their associated chains in said multiple speed chain reducer are disposed inside said boom.

7. An improved jib assembly according to claim 5, wherein said winch is driven by a second hydraulic motor through a second speed reducer, both said second motor and said second speed reducer being disposed inside said boom.

8. An improved jib assembly according to claim 6, further comprising a sleeve member operatively connecting said winch to said second speed reducer at each end of said sleeve member, said sleeve member being mounted on said shaft and extending therealong through a side wall of said boom, through said rotation output sprocket wheel and through said connecting plate, so as to be freely rotatable in relation to said shaft, said boom and said rotation output sprocket wheel.

9. An improved jib assembly according to claim 7, wherein said second speed reducer comprises a worm gear and a worm for rotating said worm gear, said worm being connected to and driven by said second motor, said worm gear being rotatably mounted on said shaft and connected to said sleeve member.

* * * * *